US011248378B2

(12) United States Patent
Iftissen

(10) Patent No.: US 11,248,378 B2
(45) Date of Patent: Feb. 15, 2022

(54) SEALING DEVICE FOR CONSTRUCTION, COMPRISING A DUCT AND CONNECTION MEMBER

(71) Applicant: RIKKSEN, Chalon sur Saone (FR)

(72) Inventor: Gérard Iftissen, Saint-martin d'uriage (FR)

(73) Assignee: RIKKSEN, Chalon sur Saone (FR)

( * ) Notice: Subject to any disclaimer, the term of this patent is extended or adjusted under 35 U.S.C. 154(b) by 21 days.

(21) Appl. No.: 16/754,889

(22) PCT Filed: Oct. 9, 2018

(86) PCT No.: PCT/FR2018/052485
§ 371 (c)(1),
(2) Date: Apr. 9, 2020

(87) PCT Pub. No.: WO2019/073161
PCT Pub. Date: Apr. 18, 2019

(65) Prior Publication Data

US 2021/0198895 A1 Jul. 1, 2021

(30) Foreign Application Priority Data

Oct. 10, 2017 (FR) ..... 1759462

(51) Int. Cl.
*E04D 13/04* (2006.01)
*B21D 39/04* (2006.01)
*E04D 13/14* (2006.01)

(52) U.S. Cl.
CPC ..... *E04D 13/0409* (2013.01); *B21D 39/04* (2013.01); *E04D 13/1407* (2013.01); *E04D 2013/0436* (2013.01)

(58) Field of Classification Search
CPC ..... E04D 13/0409; E04D 13/1407; E04D 2013/0436; B21D 39/04; B21D 19/16
See application file for complete search history.

(56) References Cited

U.S. PATENT DOCUMENTS 1,000,506 A * 8/1911 Galbraith ..... E04D 13/1476 285/44
1,380,793 A * 6/1921 Goldman ..... E04D 13/0409 285/41

(Continued)

FOREIGN PATENT DOCUMENTS

EP 1710365 A1 10/2006
EP 2395173 A1 12/2011

(Continued)

OTHER PUBLICATIONS

International Search Report dated Jan. 18, 2019, issued in corresponding International Application No. PCT/FR2018/052485, filed Oct. 9, 2018, 7 pages.

(Continued)

*Primary Examiner* — James M Ference
(74) *Attorney, Agent, or Firm* — Christensen O'Connor Johnson Kindness PLLC

(57) ABSTRACT

The present disclosure provides sealing devices and construction methods thereof. The sealing devices include a duct having a main axial portion, an intermediate annular portion facing the main axial portion, and an annular end portion facing the intermediate annular portion. The intermediate annular portion and the end annular portion are connected by an annular fold so as to form an axial annular mounting slot that is axially open opposite this annular fold. A connecting member comprises a radial plateau and, around a through-opening, an axial annular mounting portion. The axial annular mounting portion of the connection member is engaged and grasped in the axial mounting slot between the intermediate annular portion and the end annular portion of the duct.

17 Claims, 16 Drawing Sheets

(56) References Cited

U.S. PATENT DOCUMENTS 1,875,640 A * 9/1932 Moore ..... E04D 13/1476 285/44
3,467,414 A * 9/1969 Downing ..... F16L 13/165 285/382.2
3,977,137 A * 8/1976 Patry ..... E04D 13/1407 52/60
4,010,578 A * 3/1977 Logsdon ..... E04D 13/1471 52/58
4,226,449 A * 10/1980 Cole ..... B21D 39/04 285/382.2
4,269,438 A * 5/1981 Ridenour ..... B21D 39/04 285/382.2
4,333,660 A * 6/1982 Cupit ..... E04D 13/1476 277/630
4,512,119 A * 4/1985 Willoughby ..... E04D 13/1476 285/43
4,652,321 A * 3/1987 Greko ..... B29C 65/18 156/165
5,165,732 A * 11/1992 Townsend ..... F16L 13/163 126/307 R
5,390,451 A * 2/1995 Kopp ..... E04D 13/1471 285/43
5,829,214 A * 11/1998 Hart ..... E04D 13/1407 52/302.6
5,970,667 A * 10/1999 Thaler ..... E04D 13/1407 285/42
6,129,394 A * 10/2000 Bathla ..... B21D 39/046 165/178
6,185,885 B1 * 2/2001 Thaler ..... E04D 13/1407 285/42
6,279,272 B1 * 8/2001 Nill, Jr. ..... E04D 13/1471 285/43
6,654,995 B1 * 12/2003 Wang ..... B21D 39/04 219/93
7,775,005 B2 * 8/2010 Johnston ..... E04D 13/1407 52/219
8,291,658 B1 * 10/2012 Johnston ..... E04D 13/1471 52/219
8,397,438 B2 * 3/2013 Hoy ..... E04D 13/1476 52/58
8,984,822 B1 * 3/2015 Cline ..... E04D 13/1476 52/244
9,874,022 B2 * 1/2018 Hull ..... E04D 13/1476
2005/0028456 A1 * 2/2005 McLane ..... E04D 13/1407 52/58
2005/0055889 A1 * 3/2005 Thaler ..... E04D 13/1476 52/58
2005/0204648 A1 * 9/2005 Bibaud ..... E04D 13/1476 52/58
2007/0101664 A1 * 5/2007 Hoy ..... E04D 13/1476 52/198
2010/0109318 A1 * 5/2010 Mulligan ..... E04D 13/0409 285/42
2013/0020796 A1 * 1/2013 Humber ..... E04D 13/1407 285/44
2015/0267413 A1 * 9/2015 Hull ..... E04D 13/1476 52/58

FOREIGN PATENT DOCUMENTS

FR 1486657 A 6/1967
WO 2012045372 A1 4/2012

OTHER PUBLICATIONS

Written Opinion dated Jan. 18, 2019, issued in corresponding International Application No. PCT/FR2018/052485, filed Oct. 9, 2018, 12 pages.

* cited by examiner

SEALING DEVICE FOR CONSTRUCTION, COMPRISING A DUCT AND CONNECTION MEMBER

The present invention relates to a sealing device for buildings, in particular for a roof, and a method for manufacturing same.

The rooves of buildings, notably the flat roof tiles, have through-passages which are provided for the flow rainwater or the passage of chimneys. The flow or chimney ducts must be linked in a seal-tight manner to the sealings formed on the tiles.

The patent EP 1 710 365 describes a sealing device which comprises a duct provided at one end with a radial flexible membrane. The membrane has an axial annular portion gripped between an end portion of the duct and an added internal mounting ring. To avoid tearing the membrane, the internal ring and an added outer ring are provided with flanges between which a radial annular zone of the membrane is gripped.

The patent WO 2012/045372 describes a sealing device which comprises a main duct, a secondary duct of which a bottom end portion is engaged, telescopically, in a top portion of the main duct and a mounting membrane on a roof, which comprises a flange plate and an axial mounting part placed between the end portions of the main duct and of the secondary duct. The end portions of the main duct and of the second duct and the axial mounting part are deformed radially so as to form ridges that are spaced apart axially, fitted into one another. There is however a risk of direct passage of water between the end portions of the ducts.

According to one embodiment, a sealing device for buildings is proposed which comprises a duct and a link member secured to this duct.

The duct comprises a main axial portion, an intermediate annular portion facing an end annular part of the main axial portion, a terminal annular portion facing the intermediate annular portion, the intermediate annular portion and the terminal annular portion being situated radially one inside the other and linked by an annular fold so as to form an axial annular mounting slit that is open axially opposite this annular fold and the other end of the main axial portion, the intermediate annular portion extending between said end annular part of the main axial portion and the terminal annular portion.

The link member comprises a radial flange plate and, around a through-opening, an axial annular mounting portion, the radial flange plate and the axial annular mounting portion being linked by an annular fold.

The axial annular mounting portion of the link member is engaged axially and gripped or tightened radially, over at least one annular zone, in said annular mounting slit between the intermediate annular portion and the terminal annular portion of the duct.

Said main axial portion, said intermediate annular portion of the duct, said axial annular mounting portion of the link member and said terminal axial portion of the duct can have annular ridges engaged in one another.

Said intermediate annular portion can be situated inside said end annular part and said terminal annular portion can be situated inside said intermediate annular portion.

Said intermediate annular portion can be situated outside of said end annular part and said terminal annular portion can be situated outside of said intermediate annular portion.

Said terminal annular portion can be provided with an annular flange extending outward facing the link member.

Said intermediate portion can be linked to said main axial portion by an annular fold.

Said duct can be of one piece.

Said duct can comprise two assembled parts, one of which comprises said terminal annular portion, said intermediate annular portion and said end annular part of the main axial portion and the other of which comprises the other end annular part of said main axial portion; the edges of said end annular parts of said main axial portion being coupled.

The edges of said end annular parts of said main axial portion can be linked by an annular weld bead.

Said duct can comprise two assembled parts, a first part of which comprises said terminal annular portion and said intermediate annular portion linked by said annular fold and a second part of which comprises said main axial portion.

Said first part of the duct can comprise a complementary annular portion linked to said intermediate annular portion by an annular fold, said intermediate annular portion and said complementary annular portion forming an annular mounting slit in which said end annular part of said main axial portion is engaged and gripped between said intermediate annular portion and said complementary annular portion.

Said duct can be metal and said link member can be made of a bituminous or metal material.

Also proposed is a method for manufacturing a sealing device which comprises a duct and a link member comprising a radial flange plate and an axial annular mounting portion.

The method comprises: a step of folding of an end annular part of said duct, to obtain an axial annular mounting slit that is open axially outward, between an intermediate annular portion linked to a main axial portion by a first annular fold and a terminal annular portion linked to the intermediate annular portion by a second annular fold; a step of axial engagement of an axial annular mounting portion of the link member in said annular mounting slit; and a step of radial compression of said axial annular mounting portion of the link member, over at least one annular zone, between said intermediate annular portion and said terminal annular portion of the duct.

The step of radial compression can comprise a deformation of said main axial portion, of said intermediate annular portion, of said axial annular mounting portion and of the terminal annular portion, to obtain annular ridges engaged in one another.

The method can comprise a heating step during the compression step, to obtain a bonding of said axial annular mounting portion against said intermediate annular portion and of the terminal annular portion.

The method can comprise a step of at least partial heating of the duct during the folding step.

Also proposed is a method for manufacturing a sealing device comprising a duct and a link member comprising a radial flange plate and an axial annular mounting portion.

This method comprises:

a step of production of a preform comprising at least one intermediate annular portion and one terminal annular portion, linked by an annular fold and forming between them an annular mounting slit; a step of mounting of said preform on an end annular part of said duct, in a position such that said intermediate annular portion is situated between said end annular part of said duct and said terminal annular portion, and of mounting of said axial annular mounting portion of said link member in said annular mounting slit; and a step of radial compression, over at least one annular zone, of said axial annular mounting portion of the link member, of said intermediate annular portion, of said terminal annular portion of the duct and of said end annular part of said duct.

The step of production of a preform can comprise the production of a complementary annular portion linked to said intermediate annular portion, delimiting between them an annular mounting slit, the mounting step can comprise the mounting of said end annular part of said duct in this annular mounting slit and the step of radial compression can comprise the compression of said complementary annular portion.

Sealing devices for buildings will now be described by way of exemplary embodiments, illustrated by the attached drawing in which.

Figure 1:
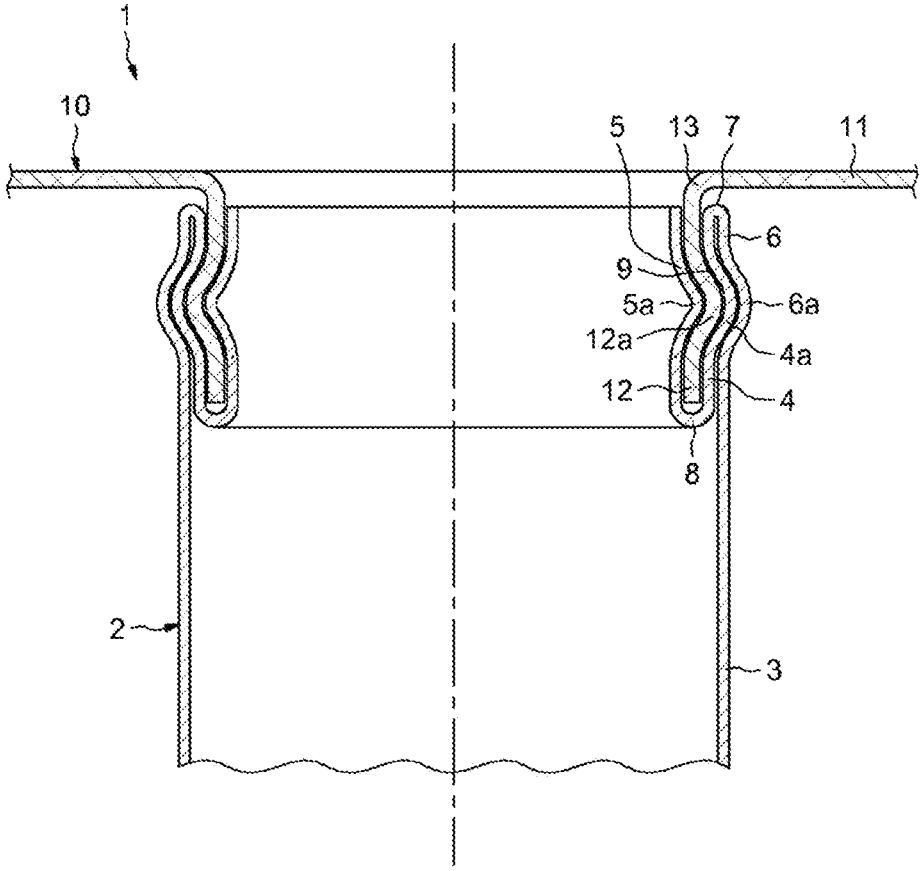
FIG. 1 represents an axial cross-section of a sealing device.

A sealing device 1, illustrated in FIG. 1, comprises a cylindrical duct 2 which has, in succession, a main axial portion 3, an intermediate annular portion 4 and a terminal annular portion 5, the intermediate annular portion 4 extending between the main axial portion 3 and the terminal annular portion 5.

The intermediate annular portion 4 is facing an end annular part 6 of the main axial portion 3 and is radially inside or encircles the latter. The main axial portion 3 and the intermediate annular portion 4 are linked to one another by a first annular fold 7.

The terminal annular portion 5 is facing the intermediate annular portion 4 and is radially inside the latter, the terminal annular portion 5 encircling the intermediate annular portion 4. The intermediate annular portion 4 and the terminal annular portion 5 are linked to one another by a second annular fold 8.

The intermediate annular portion 4 and the terminal annular portion 5 form between them an axial annular mounting slit 9 of U-shaped axial section, open axially on one side opposite the annular fold 8 and the other end of the main axial portion 3. The annular fold 8 axially forms the annular bottom of the annular mounting slit 9 which consequently is blind.

The end of the terminal annular portion 5 is substantially adjacent to the first annular fold 7, preferably axially set back inward relative to this fold 7.

The sealing device 1 further comprises a link member 10 which has a radial flange plate 11, for example with square outline, and, in its middle and around a through-opening, an axial annular mounting part 12 which protrudes on one side of the radial flange plate 11 and which is linked to the radial flange plate 11 by an annular fold 13.

The axial annular mounting part 12 of the link member 10 is engaged axially in the annular mounting slit 9 formed between the intermediate annular portion 4 and the terminal annular portion 5 of the duct 2. The faces radially opposite the axial annular mounting part 12 of the link member 10 respectively face the intermediate annular portion 4 and the terminal annular portion 5.

The annular fold 13 of the link member 10 is adjacent to the annular fold 7 of the duct 2 and passes over it. The end annular edge of the axial annular mounting part 12 is adjacent to the annular fold 8.

The axial annular mounting part 12 of the link member 10 is gripped or tightened radially by radial compression of at least one annular zone, in the annular mounting slit 9 between the intermediate annular portion 4 and the terminal annular portion 5 of the duct 2, so as to ensure the mounting.

Advantageously, the radial compression of the axial annular mounting part 12 between the intermediate annular portion 4 and the terminal annular portion 5 makes it possible to obtain a seal-tight link.

The end annular part 6 of the main axial portion 3, the intermediate annular portion 4, the axial annular mounting part 12 and the terminal annular portion 5 are for example deformed locally outward respectively in the form of annular reinforcing ridges 6*a*, 4*a*, 12*a* and 5*a* engaged in succession in one another.

Advantageously, the annular fold 7 joining the main portion 3 and the intermediate portion 4 of the duct 2 is specifically rounded and can constitute a rounded seat for the annular fold 13 of the link member 10.

According to an exemplary embodiment, the duct 2 can be metal, for example made of galvanized sheet metal or of aluminum, or of a plastic material or any other suitable material. The link member 10 can be made of a bituminous material, in the form of a flexible, or metallic, membrane, for example made of stamped sheet metal.

Figure 2:
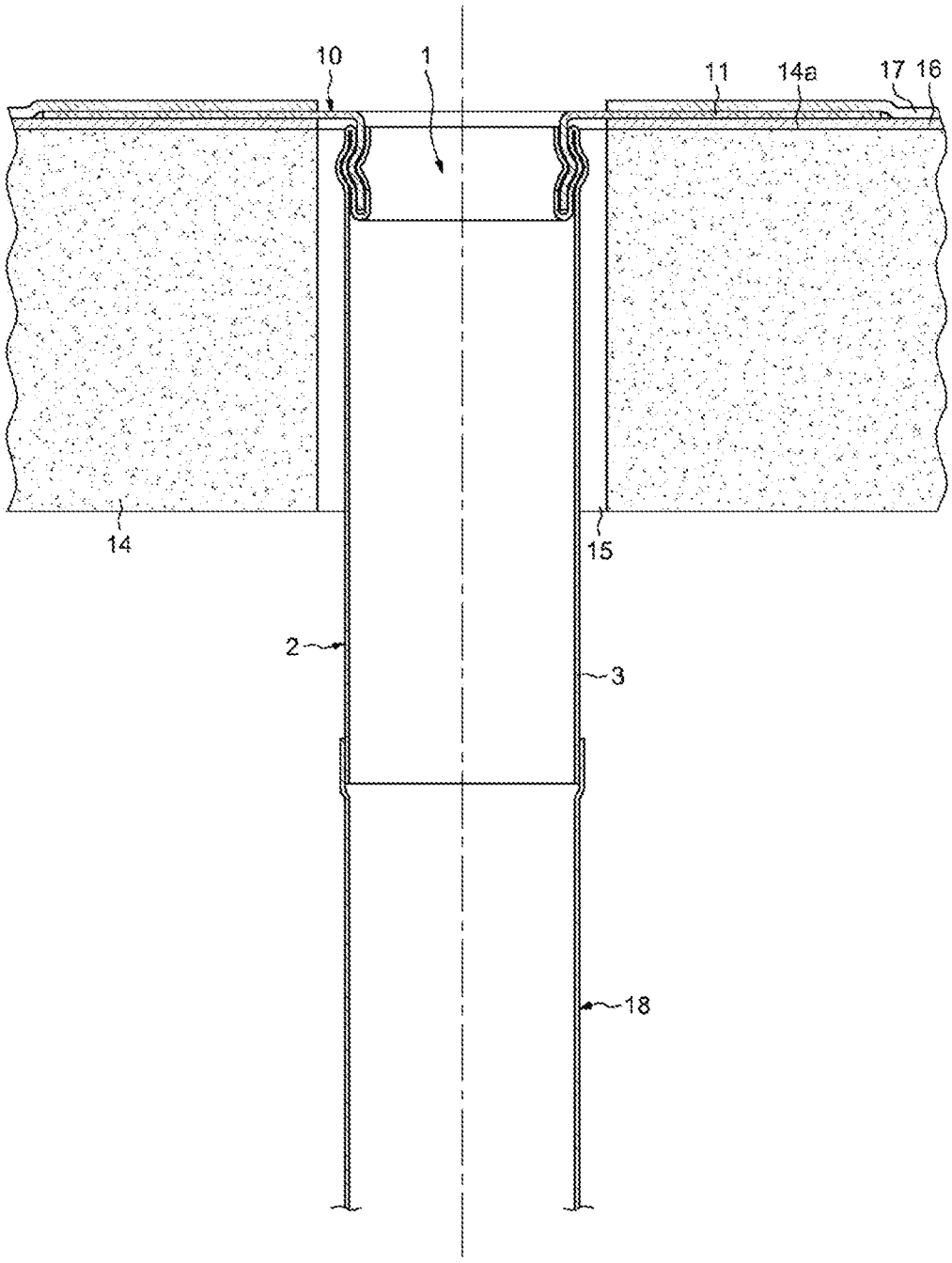
FIG. 2 represents an axial cross-section of a mounting of the sealing device of FIG. 1 on a tile of a building.

According to a use illustrated in FIG. 2, the sealing device 1 can be installed on a tile 14 of a flat or sloping roof to constitute a seal-tight link, for example as follows.

A hole 15 being formed through the tile 13, a sealing underlayer 16 is placed over the top face 14*a* of the tile 14, to close to this hole 15.

The main portion 3 of the duct 2 is engaged downward in the hole 15, until the radial flange plate 11 of the link member 10 rests on the sealing underlayer 16 and adheres thereto.

Then, optionally, an outer sealing layer 17 is placed on the underlayer 16 and on the radial flange plate 11 of the link member 10 leaving free access to the vertical passage delimited by the duct 2, the sealing layer 17 adhering to the underlayer 16 and to the radial flange plate 11 of the link member 10.

At the time of installation or later, the bottom end of the main portion 3 of the duct 2 is engaged in the top end of a discharge duct 18.

The sealing underlayer 16 and the outer sealing layer 17 can be made of a bituminous material, laid hot. Thus, the sealing underlayer 16 adheres to the tile 14, the outer sealing layer 17 adheres to the sealing underlayer 16 and the radial flange plate 11 of the link member adheres on one side to the sealing underlayer 16 and on the other side to the outer sealing layer 17.

Thus, a seal-tight link is created between the seal formed on the top surface of the tile 14 and the duct 2 via the flexible membrane 10.

In the case where the seal above the tile 14 comprises metal flange plates, the flange plate 11 of the link member 10, made of metal, can be welded to these plates.

According to a variant use, the sealing device 1 can be installed inverted, that is to say in a position such that the radial flange plate 11 of the link member 10 is placed on the tile 14, between the sealing layers 16 and 17, and the main axial portion 3 of the duct 2 extends upward, facing the hole 15 and protruding upward relative to the tile 14.

Referring to FIGS. 3 to 10, a method for manufacturing the sealing device 1 will now be described, using a machine 100, such that the duct 3 is of one piece, that is to say that the intermediate annular portion 4 and the terminal annular portion 5 are made of a single piece with the main axial portion 3.

The machine 100 comprises a horizontal plate 101 segmented in the form of jaws 102 delimiting a vertical passage 103.

Figure 3:
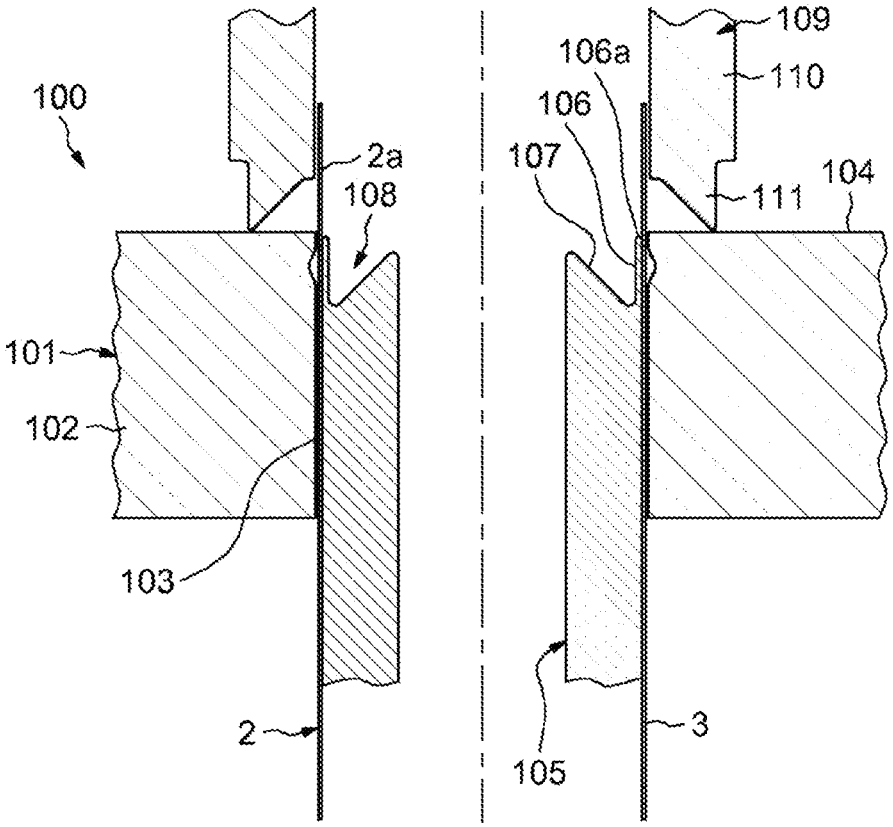
FIGS. 3 to 10 represent steps of manufacturing of the sealing device of FIG. 1 using a machine.

As illustrated in FIG. 3, there is an initial cylindrical duct 2, rectilinear from one end to the other, that is placed vertically through the passage 103, the jaws 102 being in contact with the outer face of the duct 2.

The duct 2 is disposed in a vertical position such that a top end part 2*a* of the duct 2 extends above the top radial face 104 of the plate 102. The bottom end of the duct 2 can rest on a seat (not represented).

The machine 100 comprises a cylindrical forming gauge 105 which is engaged with a small play inside the duct 2.

The top end of the gauge 105 has a cylindrical axial annular rib 106 adjacent to the internal face of the duct 2 and, from the bottom foot of this rib and on the inside, a tapered front-end surface 107, the internal flank of the rib 106 and the front-end surface 107 forming an annular groove 108 of inclined V-shaped section. The top annular edge 106*a* of the annular rib 106 is rounded. The annular bottom of the V-shaped annular groove 108 is rounded.

The gauge 105 is placed vertically in a position such that the top annular edge 106*a* of the annular rib 106 is situated in the vicinity of the top face 104 of the plate 102.

The part of the duct 2 extending downward from the annular zone adjacent to the top annular edge 106*a* of the rib 106 constitutes a main axial portion 3 of the duct 2.

The machine 100 comprises a forming tool 109 which comprises jaws 110, in the form of cylinder segments, which are disposed above the plate 102 and around the protruding part 2*a* of the duct 2. The jaws 110 have specific end segment parts 111 that will be described later.

Figure 4:
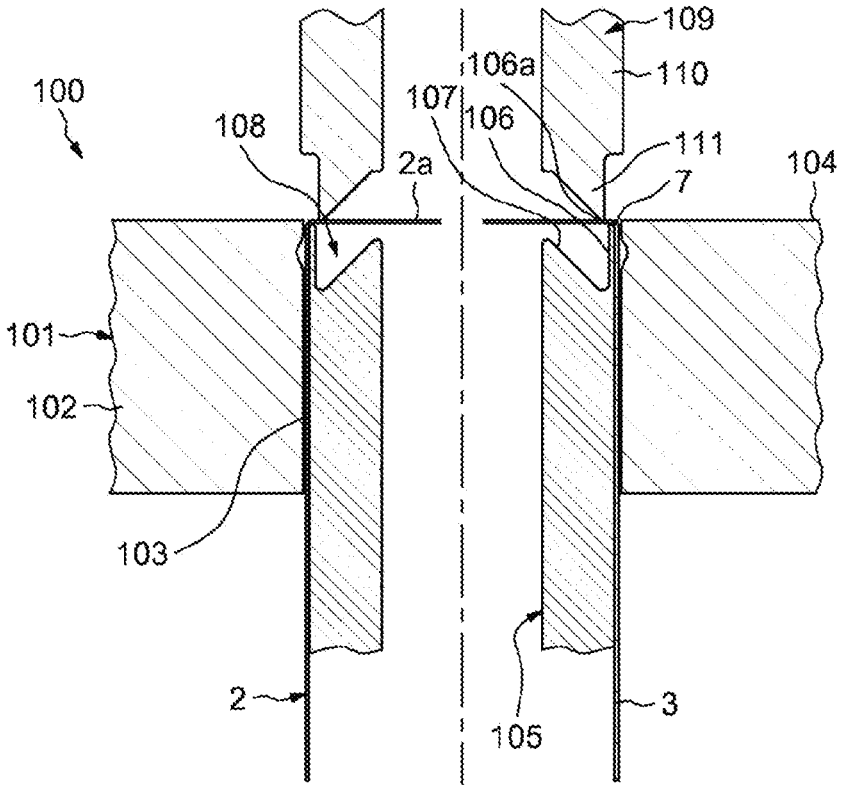

As illustrated FIG. 4, the jaws 110 are displaced radially inward so as to fold back the protruding part 2*a* of the duct 2 inward, forming an annular fold on the top annular edge of the annular rib 106 of the gauge 105. When the jaws 110 have reached a determined internal radial position, the end part 2*a* of the duct 2 extends substantially radially inward relative to the cylindrical axial portion 3 of this duct 2 and an annular fold 7 is partially formed on the top annular edge of the annular rib 106 of the gauge 105.

When this determined internal radial position is reached, the bottom end parts 111 of the jaws 110 form an annular rib complementing the groove 108 of the gauge 105.

Figure 5:
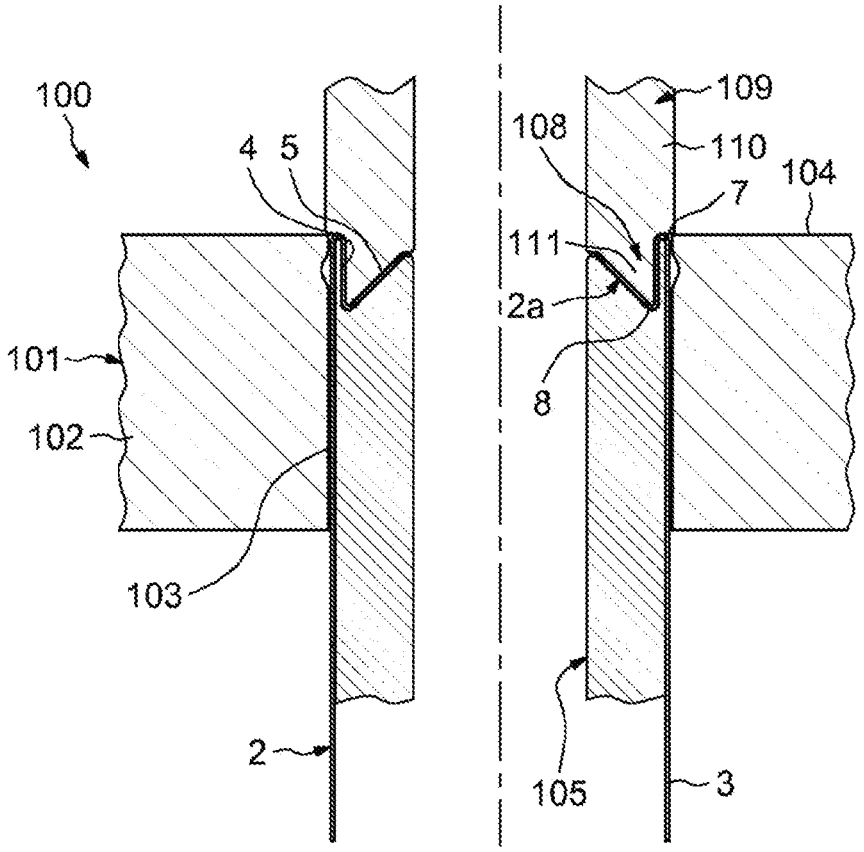

Then, as illustrated in FIG. 5, the jaws 110 are displaced axially downward toward the gauge 105 so as to continue the folding of the part 2*a* of the duct 2, toward the interior of the main axial portion 3, skirting the top annular edge 106*a* of this annular rib 106 of the gauge 105.

The movement of the jaws 110 is continued until the part 2*a* of the duct 2 is deformed to induce the partial formation of an intermediate annular portion 4 of the duct 2 against the internal face of the annular rib 106 of the gauge 105 and of a terminal annular portion 5 of the duct 2 against the tapered front-end surface 107 of the gauge 105. The annular fold 7 is accentuated and the intermediate annular portion 4 is folded back toward the main axial portion 3. An annular fold 8 is partially formed.

Figure 6:
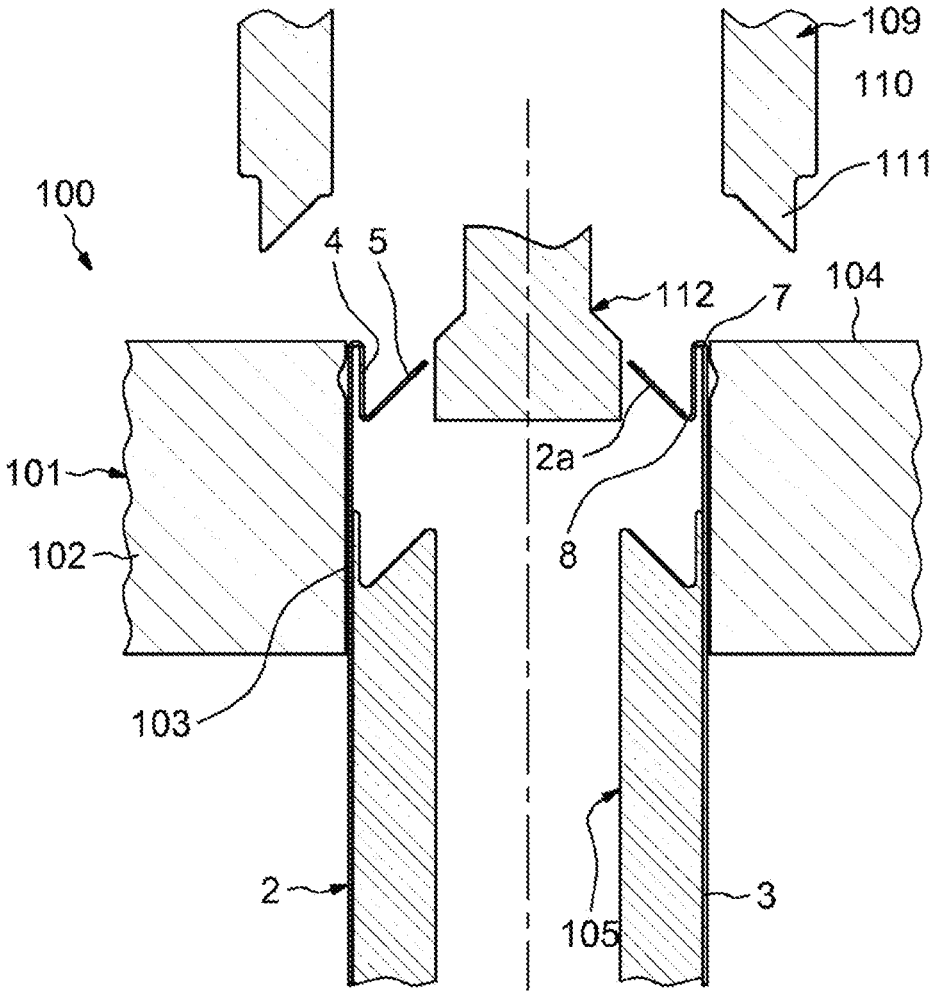

As illustrated in FIG. 6, the gauge 105 is moved away downward and the jaws 110 are separated from the tool 109.

A preform of the duct 2 is then obtained.

The machine 100 comprises a spreader tool 112 that is placed axially inside the partially formed terminal annular portion 5 of the duct 2.

Figure 7:
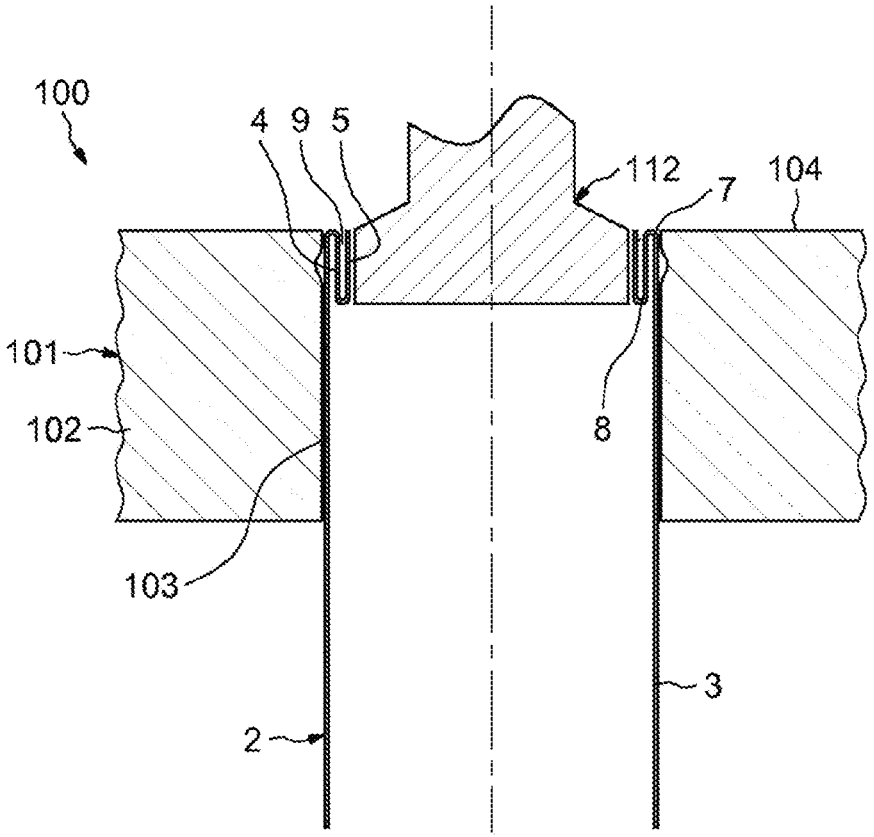

As illustrated in FIG. 7, this rotary spreader tool 112 is actuated radially outward to fold back the terminal annular portion 5 of the duct 2 toward the intermediate annular portion 4 by accentuating the annular fold 8 and form an annular slit 9 of cylindrical form and of increased thickness, between the intermediate annular portion 4 and the terminal annular portion 5 of the duct 2.

Then, the spreader tool 112 is extracted.

Figure 8:
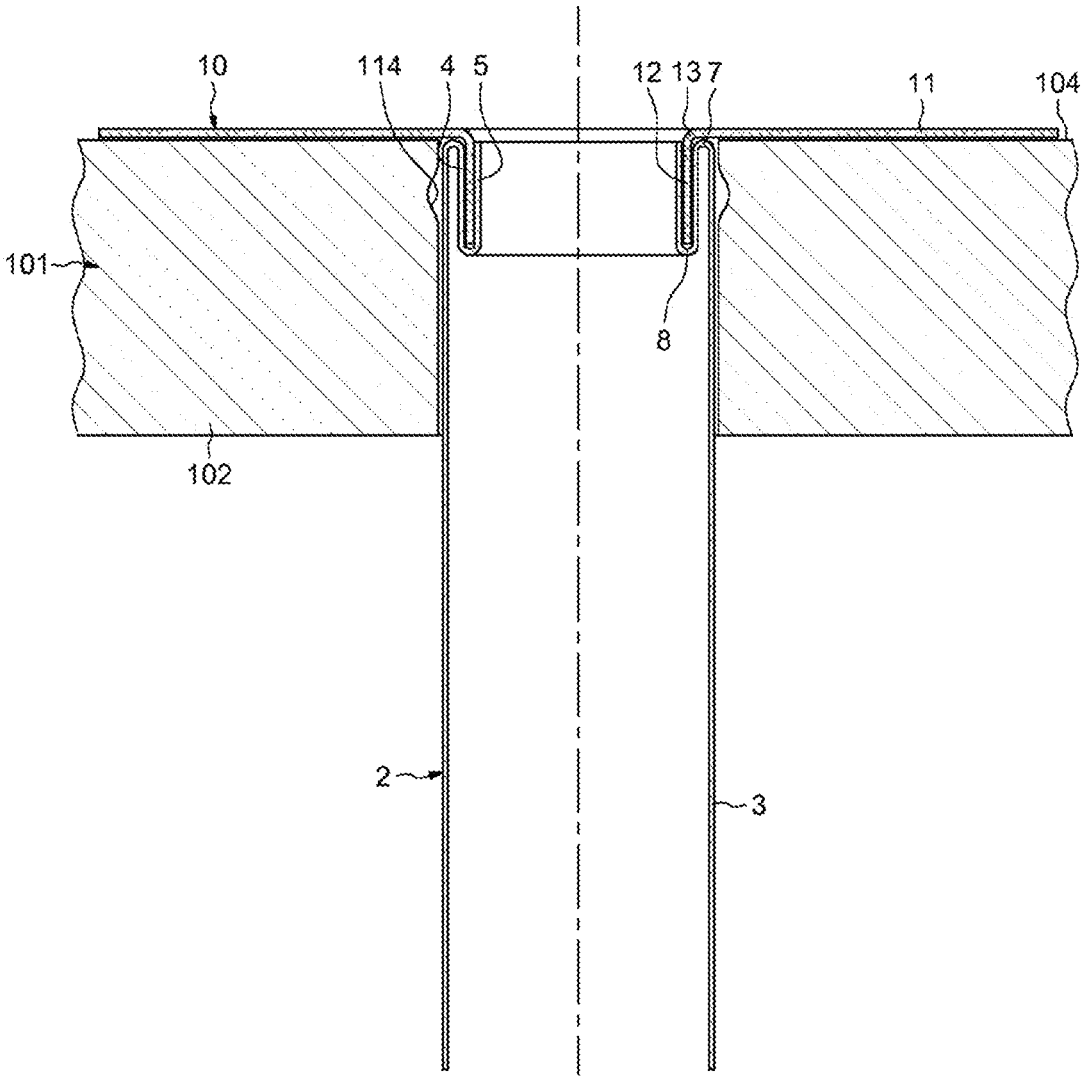

As illustrated in FIG. 8, having preformed a link member 10, its cylindrical part 12 is engaged axially in the annular slit 9, between the intermediate annular portion 4 and the terminal annular portion 5 of the duct 2 until its flange plate 11 comes to bear on the top face 104 of the plate 102.

Figure 9:
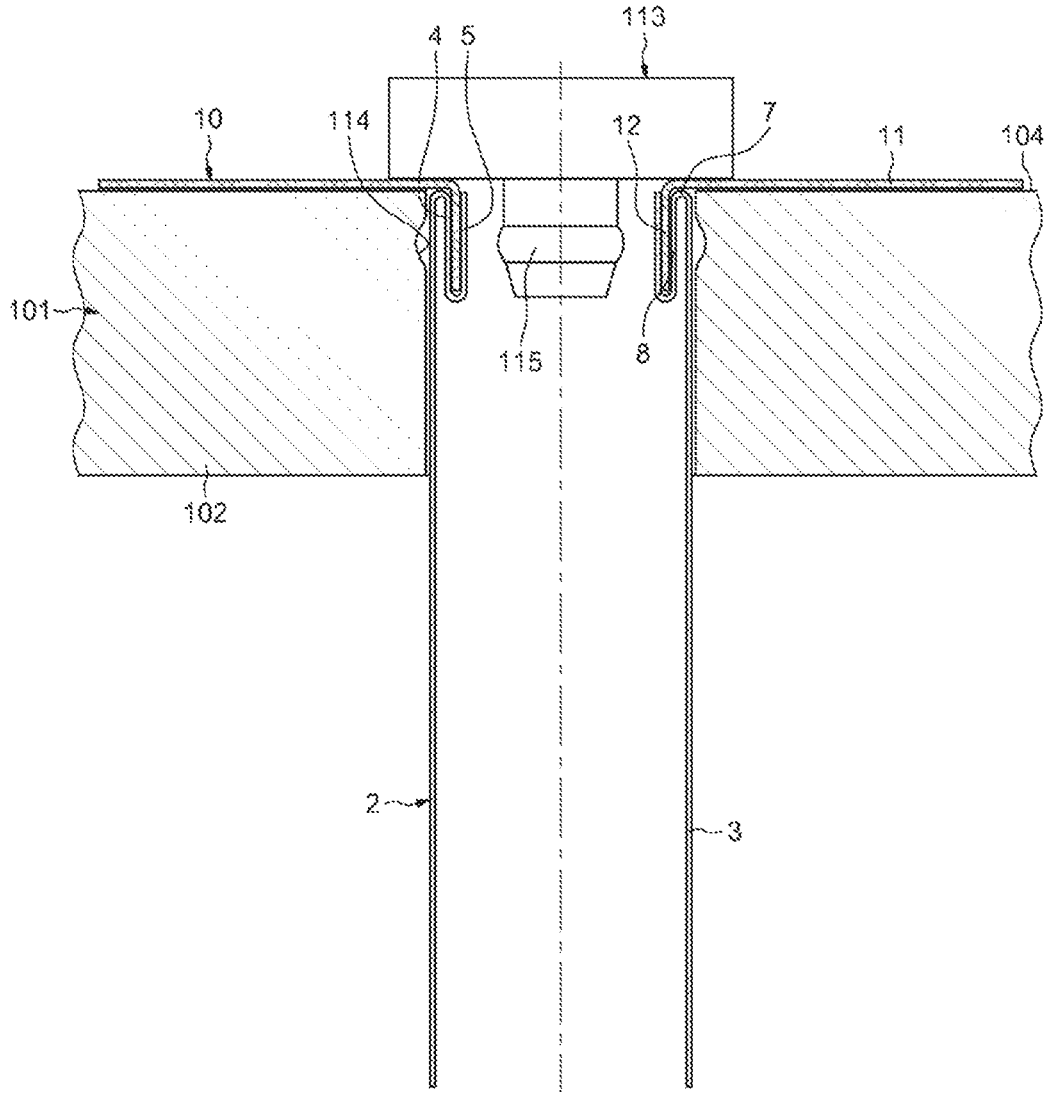

Then, as illustrated in FIG. 9, a rotary spreader tool 113 is engaged inside the terminal annular portion 5 of the duct 2.

Figure 10:
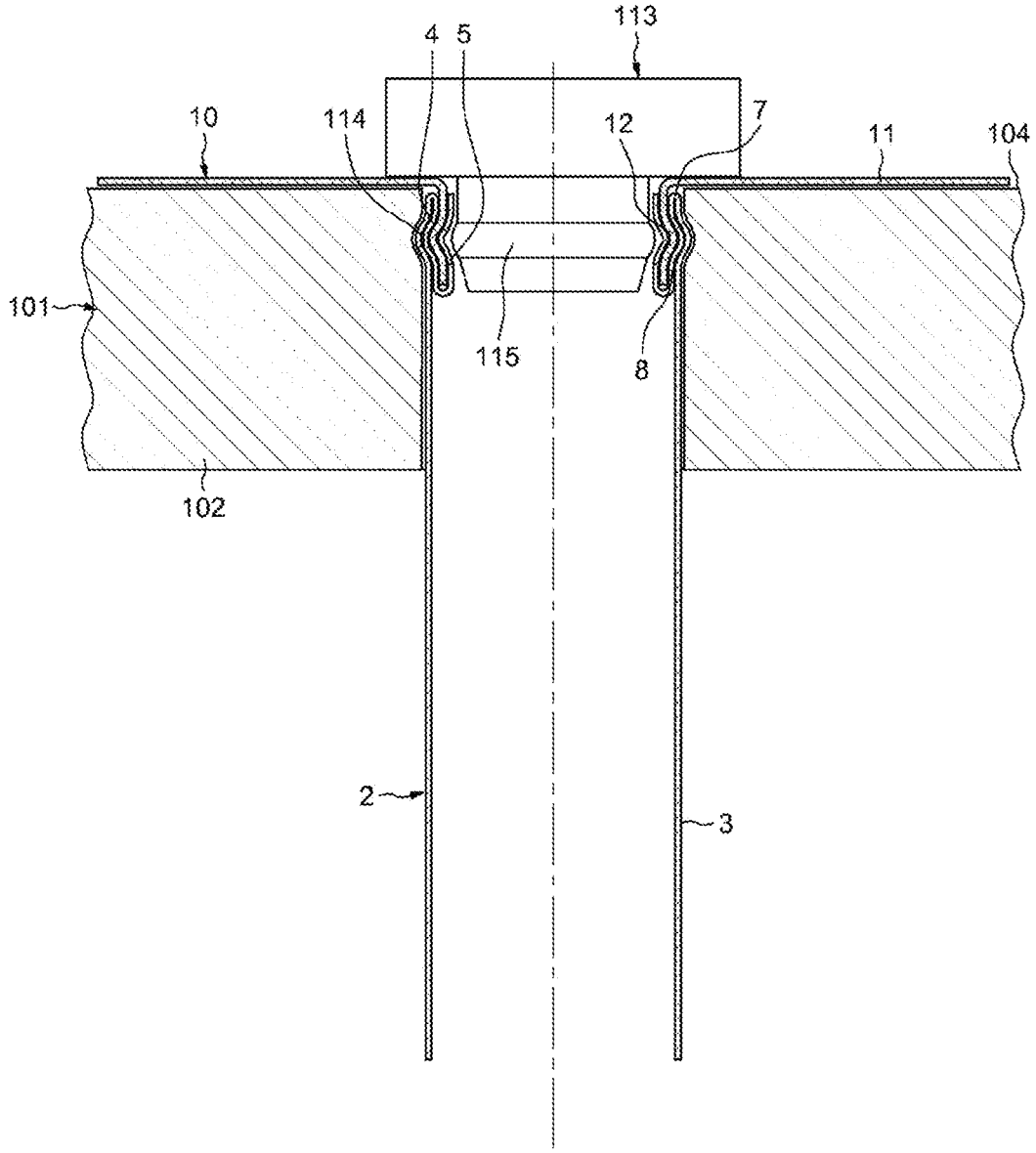

Then, as illustrated in FIG. 10, the spreader tool 113 is actuated radially outward in order to compress, radially against the internal face of the passage 103 of the plate 101, the radial stack consisting of the end annular part 6 of the main axial portion 3, the intermediate annular portion 4, the axial annular mounting part 12 and the terminal annular portion 5. That done, the gap between the intermediate annular portion 4 and the terminal annular portion 5 is reduced and the axial annular mounting part 12 of the link member 10 is tripped radially, in a seal-tight manner, between these portions 4 and 5.

The internal face of the passage 103 of the plate 101 having a protruding annular groove 114 and the spreader tool 113 having an annular boss 115 radially facing the annular groove 114, local annular ridges 6*a*, 4*a*, 12*a* and 5*a* are formed at the same time (FIG. 1).

The result thereof is that the mounting is performed by crimping.

Finally, the spreader tool 113 is extracted and the jaws 102 are separated from the plate 101.

The sealing device 1 described and illustrated in FIG. 1 is obtained.

Advantageously, the machine 100 can comprise a hot air supply device 115 in order for the cylindrical part 12 of the link member 120, heated, to adhere to the intermediate annular portion 4 and to the terminal annular portion 5 during the abovementioned compression operation. Furthermore, this input of hot air can also be useful for an at least partial heating of the duct 2 in order to facilitate the folding operations described for the top part 2*a* of the duct 2.

Figure 11:
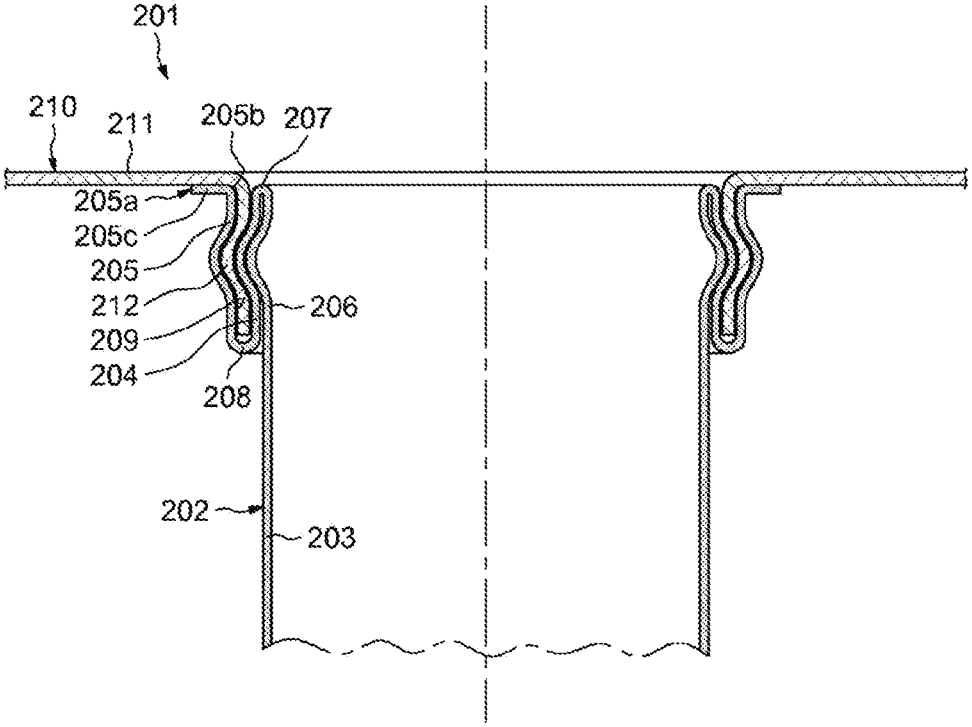
FIG. 11 represents an axial cross-section of another sealing device forming a variant embodiment of the sealing device of FIG. 1.

According to a variant embodiment illustrated in FIG. 11, a sealing device 201 comprises a duct 202 having an intermediate annular portion 204 facing and encircling an end annular part 206 of a main axial portion 203 and a terminal annular portion 205 facing and encircling this intermediate annular portion 204. The intermediate annular portion 204 and the end annular part 206 are linked by a first annular fold 207. The intermediate annular portion 204 and the terminal annular portion 205 are linked by a second annular fold 208. Consequently, the end portion 206, the intermediate annular portion 204 and the terminal annular portion 205 are radially reversed relative to the end portion 6, the intermediate annular portion 4 and the terminal annular portion 5 of the sealing device 1. The intermediate portion 204 is situated radially inside the terminal portion 205 and the end portion 206 is situated radially inside the intermediate portion 204.

In a way equivalent to the sealing device 1, the intermediate annular portion 204 and the terminal annular portion 205 form between them an axial annular mounting slit 209 of U-shaped axial section, open axially opposite the annular fold 208. The axial annular mounting slit 209 is open axially outward, on one side, opposite the other end of the main axial portion 203. The axial fold 208 axially forms the annular bottom of the annular mounting slit 209 which consequently is blind.

In a way equivalent to the sealing device 1, the sealing device 201 also comprises a link member 210 which has a radial flange plate 211 and, in its middle and around a through-opening, an axial annular mounting part 212 which protrudes on one side of the radial flange plate 211 and which is engaged axially in the axial annular mounting slit 209 between the intermediate annular portion 204 and the terminal annular portion 205. The radially opposing faces of the axial annular mounting part 212 of the link member 210 respectively face the intermediate annular portion 204 and the terminal annular portion 205.

The annular fold of the link member 10, linking the radial flange plate 211 and the axial annular mounting part 212, is adjacent to the annular fold 207 of the duct 202 and moves away therefrom. The end annular edge of the axial annular mounting part 212 is adjacent to the annular fold 208.

The axial annular mounting part 212 of the link member 10 is gripped or tightened radially by radial compression of at least one annular zone, in the annular mounting slit 209 between the intermediate annular portion 204 and the terminal annular portion 205 of the duct 202, so as to ensure the mounting.

Advantageously, the radial compression of the axial annular mounting part 212 between the intermediate annular portion 204 and the terminal annular portion 205 makes it possible to obtain a seal-tight link.

The intermediate annular portion 204 and the terminal annular portion 205 can be produced by folding by implementing tools that are radially reversed compared to those implemented to obtain the intermediate annular portion 4 and the terminal annular portion 5 of the sealing device 1. Then, as described previously, the link member 210 is put in place and the end annular part 206, the intermediate annular portion 204, the terminal annular portion 205 and the axial annular mounting part 212 are radially compressed, forming for example ridges engaged in one another.

Moreover, it is advantageous for the terminal annular portion 205 to be extended by a radial peripheral flange 205*a* extending outward facing the central part of the link member 210 and comprising a rounded annular fold 205*b* and optionally a peripheral radial part 205*c*, thus avoiding damaging the link member 210.

Figure 12:
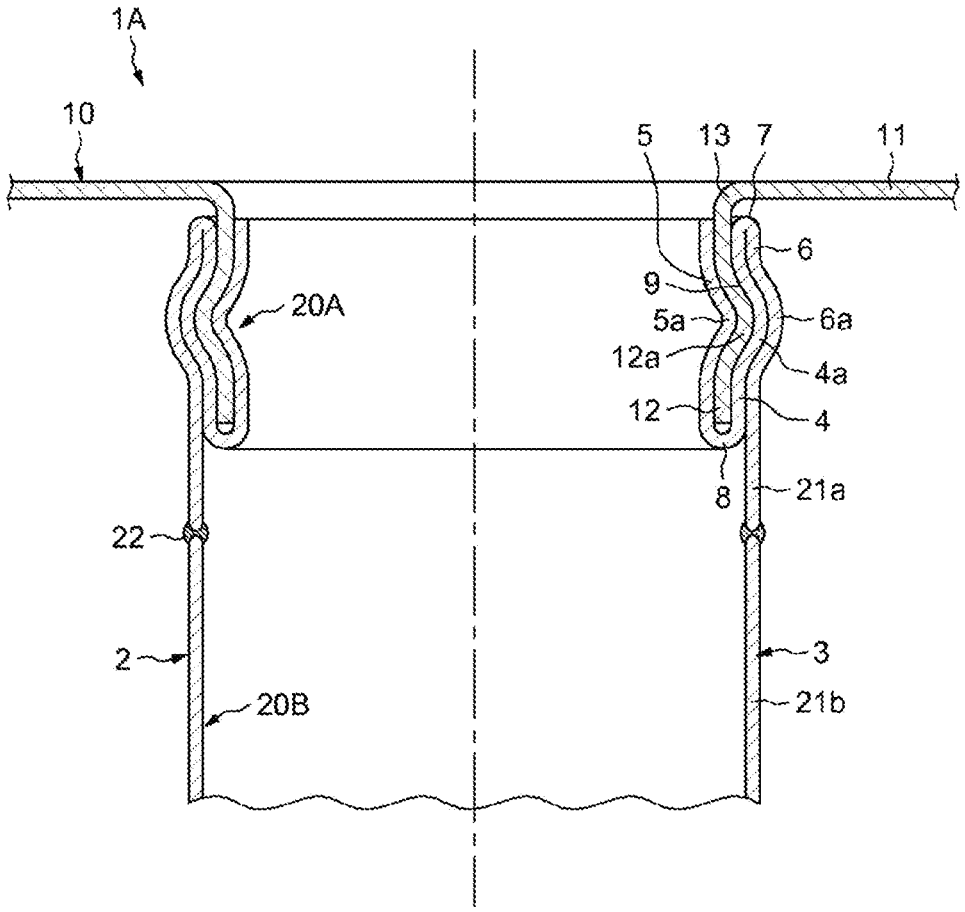
FIG. 12 represents an axial cross-section of another sealing device constituting a variant embodiment of the sealing device of FIG. 1.

FIG. 12 illustrates a sealing device 1A which constitutes a variant embodiment of the sealing device 1 of FIG. 1, in which the duct 2 comprises two parts 20A and 20B assembled with one another by welding.

The first part 20A comprises a first portion 21*a* of the main axial portion 3, starting from the fold 7 between the end annular part 6 and the intermediate annular portion 4, comprises the intermediate annular portion 4 linked to the end annular part 6 by the annular fold 7 and comprises the terminal annular portion 5 linked to the intermediate portion 4 by the annular fold 8.

The second part 20B comprises the rest of the main axial portion 3, namely a second end portion 21*b* of the main axial portion 3, this second end portion 2 consisting of a cylindrical tube.

The parts 2A and 2B are assembled by an annular weld bead 22, which is seal-tight, and which links the adjacent edges of the first portion 21*a* and of the second portion 21*b* of the main axial portion 3.

Advantageously, the first portion 21*a* of the main axial portion 3 includes the end annular part 6 situated facing the intermediate annular portion 4, the weld bead 22 being situated for example at a distance beyond the annular fold 8 between the intermediate annular portion 4 and the terminal annular portion 5, for example at a short distance.

According to a variant embodiment, the adjacent edges of the first portion 21*a* and of the second portion 21*b* of the main axial portion 3 could be engaged in one another, then welded.

Thus, the part 20A is of one piece and can be preformed, separately from the part 20B, then assembled with the part 20B by the weld bead 22.

Figure 13:
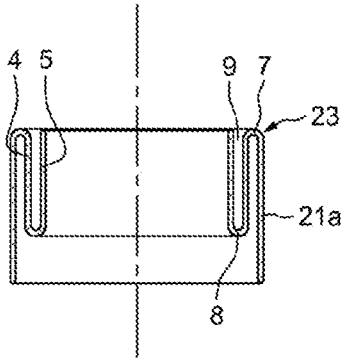
FIG. 13 represents an axial cross-section of a part of the sealing device of FIG. 12.

For example, the part 20A can be obtained from a plate in the form of an annular disk, to which there are applied one or more material stamping (folding) or embossing operations, so as to obtain a preform 23 illustrated in FIG. 13, in which the portions 4, 5 and 21*a* are substantially cylindrical. The portions 4 and 5 form between them an enlarged annular mounting slit 9.

Figure 14:
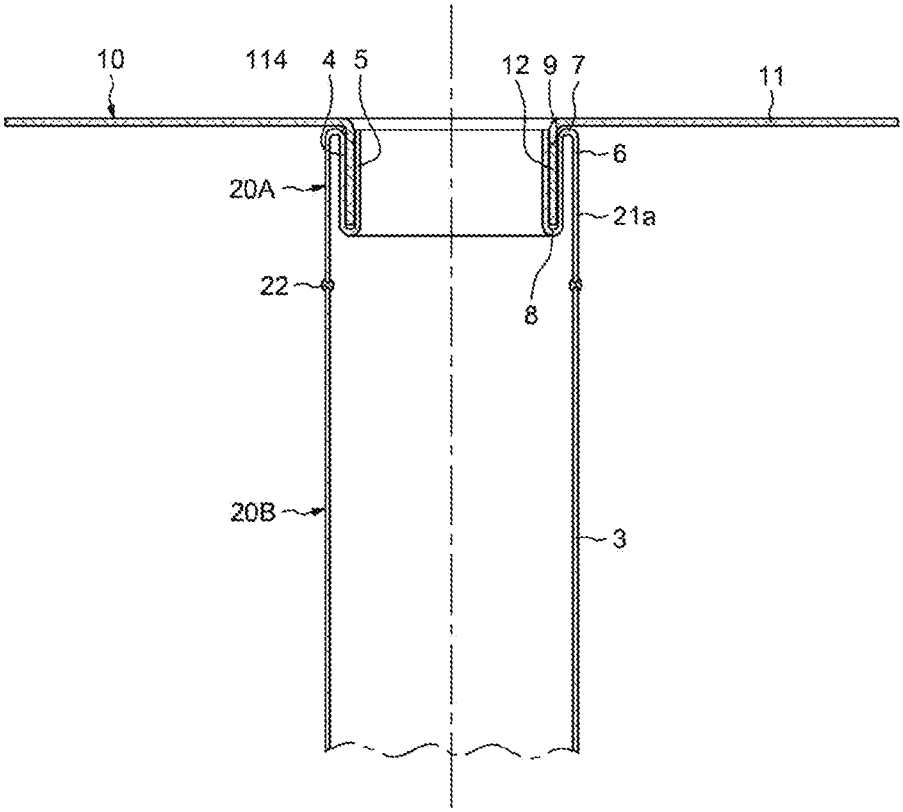
FIG. 14 represents an axial cross-section of a part of sealing device of FIG. 12, during manufacture.

Then, as illustrated in FIG. 14, the first portion 21*a* and the second portion 21*b* are abutted axially and the annular weld bead 22 is produced.

Then, the axial annular mounting part 12 of the link member 10 is engaged in the annular mounting slit 9 of the preform 23 between the intermediate annular portion 4 and the terminal annular portion 5.

Then, as described previously, using an internal rotary compression tool and external jaws, or vice versa, a radial compression operation is performed so as to form the local annular ridges 6*a*, 4*a*, 12*a* and 5*a* and to seal-tightly compress the axial annular mounting part 12 of the link member 10 in the annular mounting slit 9 between the intermediate annular portion 4 and the terminal annular portion 5, in order to obtain the sealing device 1A.

According to a variant embodiment, the link member 10 could be assembled by crimping the part 20A to the preform 23, then the parts 20A and 20B could be assembled by virtue of the annular weld bead 22.

The provisions described above with reference to FIGS. 12, 13 and 14 could also be applied in an equivalent manner to the sealing device 201 described with reference to FIG. 11, the main axial portion 203 being divided into two parts linked by an annular weld bead.

Figure 15:
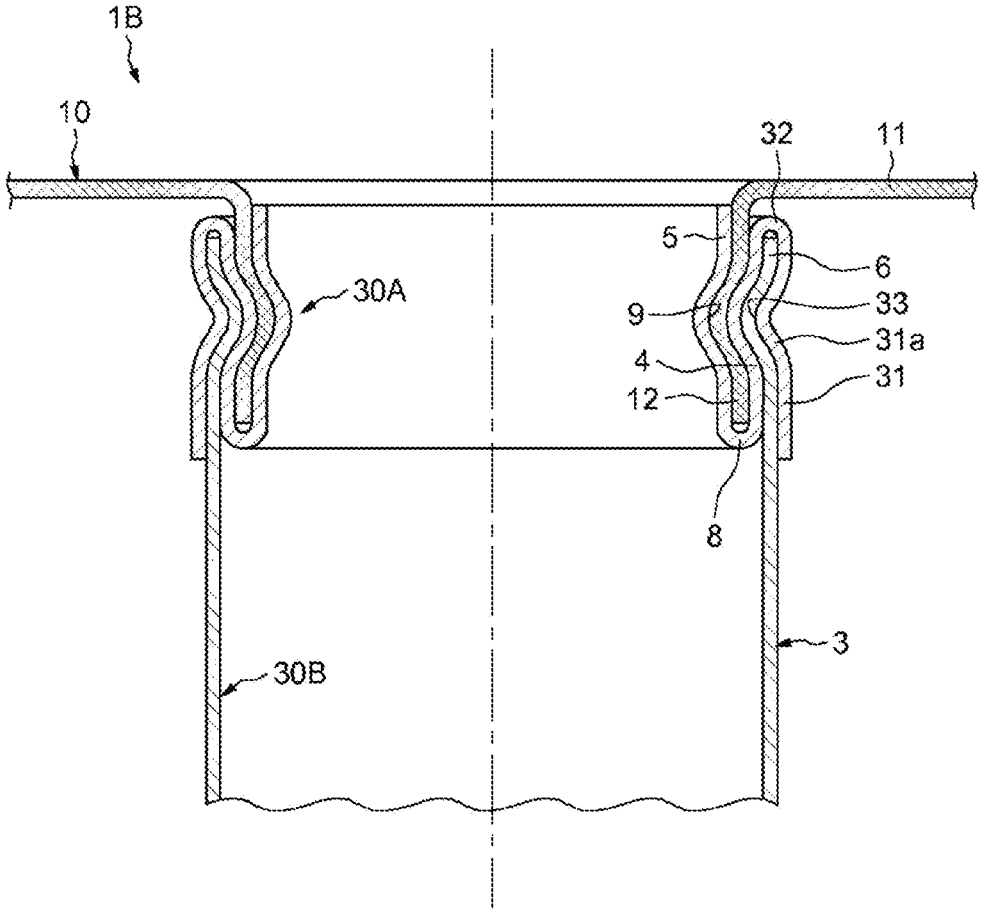
FIG. 15 represents an axial cross-section of another sealing device constituting a variant embodiment of the sealing device of FIG. 1.

FIG. 15 illustrates a sealing device 1B which constitutes a variant embodiment of the sealing device 1 of FIG. 1, in which the duct 2 comprises two parts 30A and 30B assembled with one another.

The second part 30B comprises the main axial portion 3, including the end annular part 6.

The first part 30A comprises the intermediate portion 4 and the terminal portion 5, linked by the fold 8 and forming between them the annular mounting slit 9 in which the axial annular mounting portion 12 of the link member 10 is engaged and gripped or crimped.

The part 30A further comprises a complementary annular portion 31 which is linked to the intermediate portion 4 by an annular fold 32. The intermediate portion 4 and the complementary portion 31 form between them an annular mounting slit 33, open axially opposite the annular mounting slit 9.

The end annular part 6 of the main axial portion 3 is engaged in the annular mounting slit 33, such that the complementary portion 31 encircles the end part 6 of the main axial portion 3 and the annular fold 32 skirts the end edge of the end part 6 of the main axial portion 3.

The end annular part 6 of the main axial portion 3 is gripped or crimped, by radial compression, in the annular mounting slit 33 formed between the intermediate annular portion 4 and the complementary portion 31.

The position of the annular end of the complementary portion 31 corresponds, axially, substantially to the position of the annular fold 8.

Matching those of the annular portions 4, 5, 6 and 12, the complementary portion 31 has a ridge 31*a*.

The part 30A can be preformed, separately from the part 30B, then assembled by crimping with the part 30B at the same time as the link member 10.

Figure 16:
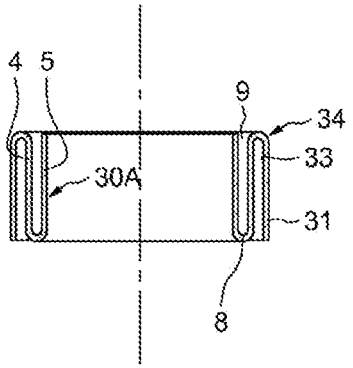
FIG. 16 represents an axial cross-section of a part of the sealing device of FIG. 15.

For example, the part 30A is of a single piece and can be obtained from a plate in the form of an annular disk, to which one or more material stamping (folding) or embossing operations are applied, so as to obtain a preform 34 illustrated in FIG. 16, in which the portions 4, 5 and 31 are substantially cylindrical. The portions 4 and 5 form between them an enlarged annular mounting slit 9 and the portions 4 and 31 form between them an enlarged annular mounting slit 33.

Figure 17:
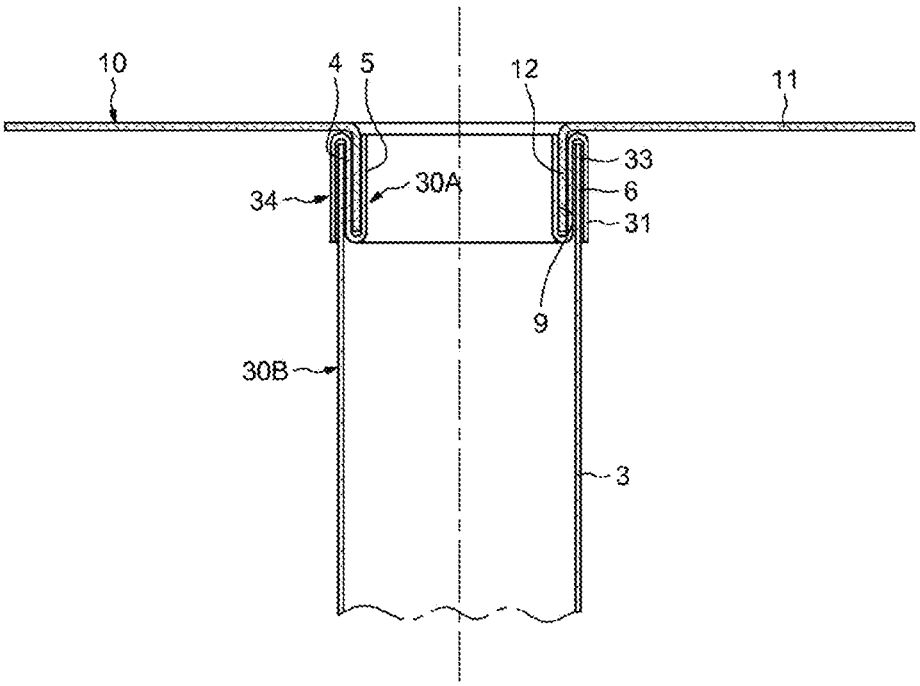
FIG. 17 represents an axial cross-section of a part of the sealing device of FIG. 15, during manufacture.

Then, as illustrated in FIG. 17, the end part 6 of the main axial portion 3 constituting the part 30B is engaged in the annular mounting slit 33 of the preform 34 and the annular portion 12 of the link member 10 is engaged in the annular mounting slit 9 of the preform 34.

Then, as described previously, using an internal rotary compression tool and external jaws, or vice versa, a radial compression operation is performed so as to form the local annular ridges 4*a*, 5*a*, 6*a*, 12*a* and 31*a* and compress the axial annular mounting part 12 of the link member 10 in the annular mounting slit 9 between the intermediate annular portion 4 and the terminal annular portion 5 and the end annular part 6 between the intermediate annular portion 4 and the complementary annular portion 31, in order to obtain, by crimping, the sealing device 1B.

The provisions described above with reference to FIGS. 15, 16 and 17 could also be applied in an equivalent manner to the sealing device 201 described with reference to FIG. 11, so as to obtain a radially reversed disposition. In this case, the annular portions 4 and 5 forming the axial mounting slit 209, are outside the end annular part 6 of the main axial portion 3 and the complementary annular portion 31 is inside the end annular part 6 of the main axial portion 3. Optionally, the terminal annular part 205 can be provided with a radial flange protruding outward, equivalent to the flange 205*a*.

According to a variant embodiment, the complementary annular part 31 of the part 30A could be situated between the intermediate annular portion 4 and the end part 6 of the main axial portion 3 constituting the part 30B.

The complementary annular portion 31 of the part 30A could be welded to the main axial portion 3 constituting the part 30B by an annular weld bead provided at an end of the complementary annular portion 31 or annular weld beads provided at the ends of the complementary annular portion 31. In another case, the part 30A could be added to the part 30B without welding.

Figure 18:
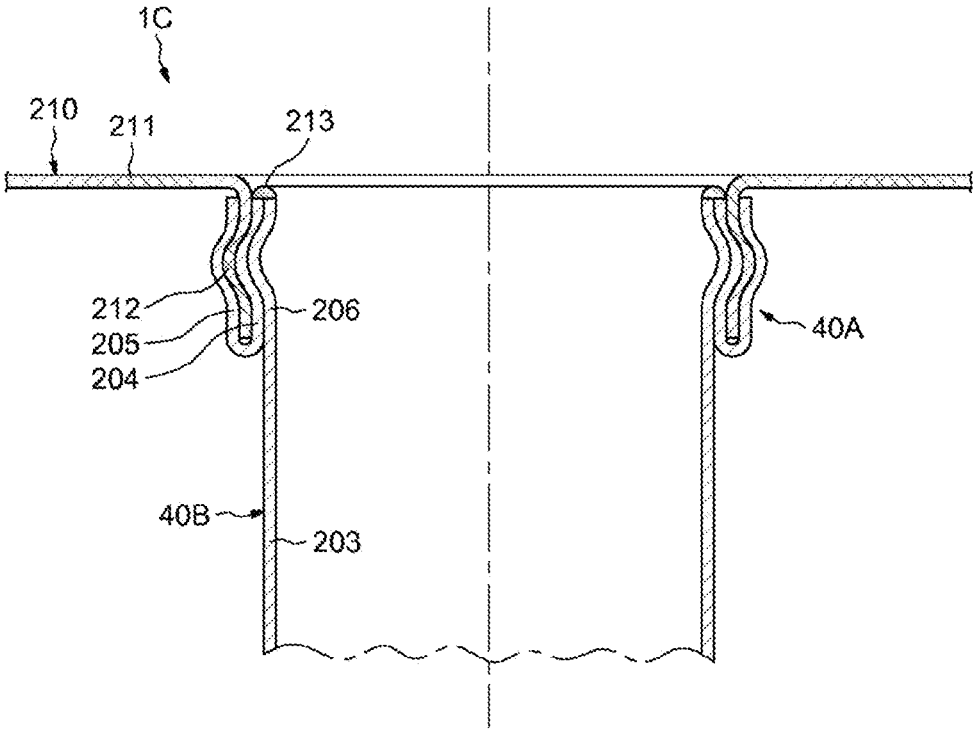
FIG. 18 represents an axial cross-section of another sealing device constituting a variant embodiment of the sealing device of FIG. 11.

FIG. 18 illustrates a sealing device 1C which constitutes a variant embodiment of the sealing device 201 of FIG. 11, in which the duct 2 comprises two parts 40A and 40B assembled with one another.

The second part 40B comprises the main axial portion 203, including the end annular part 206.

The first part 30A comprises the intermediate portion 204 and the terminal portion 205, linked by the fold 208 and forming between them the annular mounting slit 209 in which the axial annular mounting portion 212 of the link member 210 is engaged and gripped by crimping upon the radial compression of the portions 4, 5 and 6 and 212.

The first part 30A can be preformed then assembled by crimping with the end annular part 206 of the main axial portion 203, at the same time as the axial annular mounting portion 212 of the link member 210.

Optionally, the intermediate annular portion 204 of the part 40A could be welded to the main axial portion 203 constituting the part 40B by an annular weld bead 213 provided at an end of the annular portion 204 or annular weld heads provided at the ends of the intermediate annular portion 204. In another case, the part 40A could be added to the part 40B without welding.

The provisions described above with reference to FIG. 18 could also be applied in an equivalent manner to the sealing device 1 described with reference to FIG. 1. In this case, the first part 30A would be inside the end annular part 206 of the main axial portion 203.

The invention claimed is:

1. A sealing device, comprising:

a duct; and a link member secured to the duct;

wherein the duct comprises:

a main axial portion;

an intermediate annular portion facing an end annular part of the main axial portion;

a terminal annular portion facing the intermediate annular portion, the terminal annular portion being situated radially inside the intermediate annular portion, or the intermediate annular portion being situated radially inside the terminal annular portion, the intermediate annular portion and the terminal annular portion being linked by an annular fold to form an axial annular mounting slit that is open axially opposite the annular fold and opposite another end annular part of the main axial portion, the intermediate annular portion extending between the end annular part of the main axial portion and the terminal annular portion;

wherein the link member comprises a radial flange plate and, around a through-opening, an axial annular mounting portion, the radial flange plate and the axial annular mounting portion being linked by a second annular fold;

wherein the axial annular mounting portion of the link member is engaged axially and gripped radially, over at least one annular zone, in the annular mounting slit between the intermediate annular portion and the terminal annular portion of the duct, and wherein the main axial portion, the intermediate annular portion of the duct, the axial annular mounting portion of the link member and the terminal axial portion of the duct have annular ridges engaged in one another.

2. The sealing device as claimed in claim 1, wherein the intermediate annular portion is situated inside the end annular part and the terminal annular portion is situated inside the intermediate annular portion.

3. The sealing device as claimed in claim 1, wherein the intermediate annular portion is situated outside of the end annular part and the terminal annular portion is situated outside of the intermediate annular portion.

4. The sealing device as claimed in claim 3, wherein the terminal annular portion is provided with an annular flange extending outward facing the link member.

5. The sealing device as claimed in claim 4, wherein the duct is of one piece.

6. The sealing device as claimed in 1, wherein the intermediate portion is linked to the main axial portion by a third annular fold.

7. The sealing device as claimed in claim 6, wherein the duct comprises a first part and a second part assembled together, wherein one of the first part or the second part comprises the terminal annular portion, the intermediate annular portion and the end annular part of the main axial portion, and wherein the other of the first part or the second part comprises another end annular part of the main axial portion wherein edges of the end annular parts of the main axial portion are coupled.

8. The sealing device as claimed in claim 7, wherein the edges of the end annular parts of the main axial portion are linked by an annular weld bead.

9. The sealing device as claimed in claim 1, wherein the duct comprises two assembled parts, a first part of which comprises the terminal annular portion and the intermediate annular portion, linked by the annular fold, and a second part of which comprises the main axial portion.

10. The sealing device as claimed in claim 9, wherein the first part of the duct comprises a complementary annular portion linked to the intermediate annular portion by an annular fold, the intermediate annular portion and the complementary annular portion forming an annular mounting slit in which the end annular part of the main axial portion is engaged and gripped between the intermediate annular portion and the complementary annular portion.

11. The sealing device as claimed in claim 1, wherein the duct is metal and the link member is made of a bituminous or metal material.

12. A method for manufacturing a sealing device comprising a duct and a link member, the link member comprising a radial flange plate and an axial annular mounting portion, the method comprising:

folding an end annular part of the duct, to obtain an axial annular mounting slit that is open axially outward, between an intermediate annular portion linked to a main axial portion a first annular fold and a terminal annular portion linked to the intermediate annular portion a second annular fold;

axially engaging the axial annular mounting portion of the link member inside the annular mounting slit; and radially compressing the axial annular mounting portion of the link member, over at least one annular zone, between the intermediate annular portion and the terminal annular portion of the duct.

13. The method as claimed in claim 12, wherein the radially compressing comprises deforming the main axial portion, of the intermediate annular portion, of the axial annular mounting portion, and of the terminal annular portion, to obtain annular ridges engaged in one another.

14. The method as claimed in claim 12, further comprising heating during the radially compressing, thereby obtaining a bonding of the axial annular mounting portion against the intermediate annular portion and of the terminal annular portion.

15. The method as claimed in claim 12, further comprising heating the duct during the folding.

16. A method for manufacturing a sealing device comprising a duct and a link member, the link member comprising a radial flange plate and an axial annular mounting portion, the method comprising:

producing a preform comprising at least one intermediate annular portion and a terminal annular portion linked by an annular fold and forming between the at least one intermediate annular portion and the terminal annular portion an annular mounting slit;

mounting the preform on an end annular part of the duct, in a position such that the intermediate annular portion is situated between the end annular part of the duct and the terminal annular portion, and mounting the axial annular mounting portion of the link member in the annular mounting slit; and radially compressing the axial annular mounting portion of the link member, over at least one annular zone, between the at least one intermediate annular portion and the terminal annular portion.

17. The method as claimed in claim 16, wherein producing the preform comprises producing a complementary annular portion linked to the intermediate annular portion, delimiting between the complimentary annular portion and the intermediate annular portion an annular mounting slit, mounting the preform comprises mounting the end annular part of the duct in the annular mounting slit, and wherein radially compressing comprises compressing the complementary annular portion.

* * * * *